US010341755B2

(12) United States Patent
Choi et al.

(10) Patent No.: US 10,341,755 B2
(45) Date of Patent: Jul. 2, 2019

(54) WEARABLE SOUND EQUIPMENT

(71) Applicant: LG ELECTRONICS INC., Seoul (KR)

(72) Inventors: Hyengcheul Choi, Seoul (KR); Jaehyun Choi, Seoul (KR); Deuksu Choi, Seoul (KR); Dongjin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 66 days.

(21) Appl. No.: 15/256,331

(22) Filed: Sep. 2, 2016

(65) Prior Publication Data

US 2017/0353781 A1 Dec. 7, 2017

(30) Foreign Application Priority Data

Jun. 1, 2016 (KR) ..... 10-2016-0068191

(51) Int. Cl.
*H04R 1/10* (2006.01)
*H04R 3/04* (2006.01)

(52) U.S. Cl.
CPC ..... *H04R 1/1016* (2013.01); *H04R 1/105* (2013.01); *H04R 1/1033* (2013.01); *H04R 3/04* (2013.01); *H04R 2420/07* (2013.01)

(58) Field of Classification Search
None
See application file for complete search history.

(56) References Cited

U.S. PATENT DOCUMENTS 2,899,549 A * 8/1959 Potter ..... H01B 7/04 343/720
5,715,323 A * 2/1998 Walker ..... H04R 1/10 351/123
6,091,832 A * 7/2000 Shurman ..... G02C 11/06 2/422
6,535,170 B2 * 3/2003 Sawamura ..... H01Q 1/243 343/700 MS
6,980,154 B2 * 12/2005 Vance ..... H01Q 1/243 343/700 MS
7,532,718 B2 * 5/2009 Cohen ..... H04B 1/385 343/718

(Continued)

FOREIGN PATENT DOCUMENTS

EP 2919482 A2 * 9/2015 ..... H04R 1/1091

*Primary Examiner* — Duc Nguyen
*Assistant Examiner* — Taunya McCarty
(74) *Attorney, Agent, or Firm* — Lee, Hong, Degerman, Kang & Waimey

(57) ABSTRACT

A wearable sound equipment includes a main body, an earbud outputting sound, a board loaded in the main body and including a ground, a cable having one end connected to the main body and the other end connected to the earbud, and including an audio line and a ground line, an audio chipset connected to the audio line and transmitting a sound signal to an audio output unit of the earbud, an antenna radiator loaded in the main body, a feeder connecting the board and one end of the antenna radiator with each other and supplying electric power to the antenna radiator; and a ground connection connecting one end of the ground line with the ground of the board, wherein the ground connection is arranged near the feeder.

14 Claims, 10 Drawing Sheets

(56) References Cited

U.S. PATENT DOCUMENTS

| | | | | |
|---|---|---|---|---|
| 7,603,150 | B2 * | 10/2009 | Takahashi | H01Q 1/242<br>455/575.1 |
| 7,633,446 | B2 * | 12/2009 | Fang | H01Q 1/243<br>343/700 MS |
| 8,094,859 | B2 * | 1/2012 | Suematsu | H01Q 1/273<br>379/430 |
| 8,428,287 | B2 * | 4/2013 | Rabu | H04R 1/1033<br>381/370 |
| 2010/0056096 | A1 * | 3/2010 | Koerner | H01Q 1/46<br>455/334 |
| 2011/0294537 | A1 * | 12/2011 | Vance | H01Q 1/52<br>455/550.1 |
| 2013/0002510 | A1 * | 1/2013 | Azulay | H01Q 1/243<br>343/860 |
| 2013/0078932 | A1 * | 3/2013 | Asrani | H01Q 1/243<br>455/90.3 |
| 2014/0378958 | A1 * | 12/2014 | Leussler | A61B 18/1815<br>606/33 |

* cited by examiner

WEARABLE SOUND EQUIPMENT

CROSS-REFERENCE TO RELATED APPLICATIONS

Pursuant to 35 U.S.C. § 119(a), this application claims the benefit of earlier filing date and right of priority to Korean Patent Application No. 10-2016-0068191, filed on Jun. 1, 2016, the contents of which are hereby incorporated by reference in its entirety.

BACKGROUND OF THE DISCLOSURE

Field of the Disclosure

Embodiments of the present disclosure relate to a wearable sound equipment which may receive an sound signal from a terminal and transmit a control signal for controlling the terminal by wireless communication.

Background of the Disclosure

The sound equipment means the audio device which is able to receive a sound signal from a terminal and transmit the audio information collected via a microphone. Typically, wire type sound equipment is used in a conventional mobile terminal and the wire type sound equipment connects a terminal of a wireless sound equipment to an ear jack of a terminal to receive an sound signal. In recent, there are increasing demands for the wireless communication type wireless sound equipment in an aspect of mobility and user convenience.

Wireless sound equipment having the design considering mobility is under development and example of the wireless sound equipment having such the design include band-shaped headphone type wireless sound equipment, ear wearable type wireless sound equipment and ear inserting type wireless sound equipment. The band-shaped headphone type is worn on a user's head and facilitates the user's carrying.

Such conventional wearable sound equipment is only able to tranceive data by wireless communication with a mobile terminal connected thereto and has a disadvantage of unavailable without an external terminal. In recent, there are increasing needs for the wearable sound equipment including a wireless communication module which is able to communicate with a base station itself or receive a radio signal directly to allow the user to listen to music even without an auxiliary external terminal.

As she user may always carry such the wearable sound equipment with himself or herself, the wearable sound equipment become located close to the human body. Performance securing and the effects on physiological responses become issued. Because of its relatively small size, the wearable sound equipment has the insufficient space for securing the performance of auxiliary antenna.

SUMMARY OF THE DISCLOSURE

Accordingly, an object of the present invention is to address the above-noted and other problems.

An object of the present disclosure is to wearable sound equipment which may improve antenna performance by minimizing the change of conventional configuration and structure and minimize the effect on human body.

Embodiments of the present disclosure may provide a wearable sound equipment comprising a main body wearable on a user's body part; an earbud comprising an audio output unit outputting sound; a board loaded in the main body and comprising a ground; a cable having one end connected to the main body and the other end connected to the earbud, and comprising an audio line and a ground line; an audio chipset connected to the audio line and transmitting a sound signal to the audio output unit of the earbud; an antenna radiator loaded in the main body; a feeder connecting the board and one end of the antenna radiator with each other and supplying electric power to the antenna radiator; and a ground connection connecting a first end of the ground line with the ground of the board, wherein the feeder and the ground connection are proximately located at one end portion of the board.

The ground connection may be located closer to an end of the board.

A second end of the ground line may be located distant from the earbud.

The second end of the ground line may extend from the first end toward the earbud and be bent inside the cable toward the main body such that a second end of the ground line is located at a portion of the cable that is located between a bent portion of the ground line and the first end.

The ground line may comprise a coil spirally wound around a middle portion of the ground line.

The antenna radiator may be disposed on the board and overlapped with the board.

The main body may comprise a metal case located at a second surface of the main body, the second surface is opposite to a first surface of the main body configured to contact with the user, and the board and the antenna radiator are located between the first surface and the second surface such that the board may be at a side of the first surface and the antenna radiator is at a side of the second surface.

The main body may comprise a band portion curved in a C-shape and wearable around the user's neck; and a pair of housings each formed at a corresponding end of the band portion, wherein the earbud comprises a pair of earbuds and the cable may be extended along the band portion such that each of the pair of earbuds is coupled to a corresponding end of the band portion, and the wearable sound equipment may further comprise an FM chipset connected to the ground line and receiving an FM signal.

The wearable sound equipment may further comprise an FM matching network connecting the ground line and the ground of the board with each other.

The wearable sound equipment may further comprise a filter device connecting the ground line and the ground of the board and shutting off a signal in a frequency band corresponding to the FM signal.

Embodiments of the present disclosure may also disclose a wearable sound equipment comprising a main body comprising a band portion shaped to be wearable around a neck of a user, the main body further comprising a pair of housings each formed at a corresponding end of the band portion; a pair of earbuds, each comprising an audio output unit outputting sound; a cable extended along the band portion having both ends coupled to the earbuds, respectively, the cable comprising an audio line and a ground line; an audio chipset coupled to the audio line and transmitting a sound signal to the audio output module of the earbud; a FM chipset coupled to the ground line and receiving FM signal; a board located in the pair of housings and comprising the audio chipset, the FM chipset and a ground; and a FM matching network connecting the ground line and the ground.

The length of the ground line may be corresponding to one fourth of the wavelength of the FM signal.

The length of the ground line may be 70 cm~85 cm.

The cable may be exposed outside, penetrating one end of the housing.

The wearable sound equipment may further comprise a filter device connecting the ground line and the ground of the board and shutting off a signal in a frequency band corresponding to the FM signal.

The board may comprise a first board loaded in one of the housings and in which the audio chipset and the FM chipset are mounted; and a second board located in the other one of the pair of housings in which the filter device is located.

The wearable sound equipment may further comprise an audio matching network connecting the ground line and the ground.

According to the embodiments of the present disclosure, the filter device shutting off the signal in the frequency band corresponding to the FM signal may be provided. The filter device may shut off electric currents flowing to the second board and the ground connection of the ground line with respect to the FM frequency signal and allows electric currents flowing along the ground line of the cable.

As mentioned above, the flux of the electric field formed by the antenna radiator is adjusted by using the cable or the metal case exposed outside. Accordingly, the antenna performance may be improved and the effect on the human body may be minimized.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
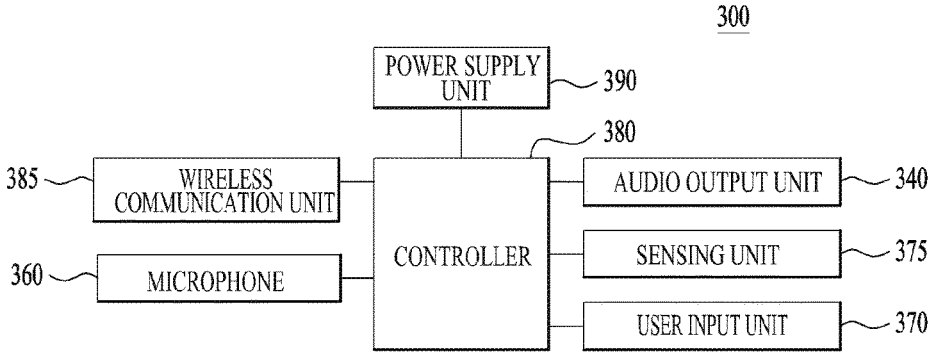
FIG. 1 is a block diagram illustrating a structure of wearable sound equipment in accordance with the present disclosure.

FIG. 1 is a block diagram illustrating a structure of wearable sound equipment in accordance with the present disclosure. The wearable sound equipment 300 in accordance with the present disclosure includes a controller 380, a wireless communication unit 385, an audio output unit 340, a sensing unit 375, a microphone 360, a user input unit 370 and a power supply unit 390.

The audio output unit 340 is the mechanism configured to output sounds according to a sound signal. For example, the audio output unit 340 may be included in an earbud that is insertedly put on a user's ear to transmit sounds to the user.

The microphone 360 processes an external sound signal into electrical voice data. The processed voice data is transmitted to an external terminal or server via the wireless communication unit 385. Various noise removal algorithms can be realized in the microphone 360 to remove the noise generated while the external sound signal is input.

The sensing unit 375 is the device configured to recognize the state of the wearable sound equipment 300 and circumstances. The sensing unit 375 may include an illuminance sensor for sensing ambient illuminance, a touch sensor for sensing touch input, a gyro sensor for sensing the slope and location of the wearable sound equipment 300 and an earbud switch for sensing whether the earbud 341 is located in an earbud holder 325.

The user input unit 370 is configured to allow the user to control the wearable sound equipment 300. The user input unit 370 may include a call button 372, a sound volume button 373 for sound volume, a power button 371 and a storage button for storing the cable 345 in the housing 320.

The user input unit 370 may include only a call button and a pair of sound volume buttons. Alternatively, it may further include a play/stop button and a play order change button. The size of the wearable sound equipment 300 is restricted and the user often implements input without seeing the buttons directly. If many buttons are provided in the user input unit 370, it is difficult for the user to distinguish each function of the buttons from the other. The limited number of the buttons is used and the time and frequency of the user's button pressing and the plurality of the buttons are combined, only to expand inputtable control commands.

The wearable sound equipment 300 is kept on being worn on the user's body and has little possibility of getting lost. In contrast, the conventional mobile terminal is more likely to get lost. To prevent the loss, if the user presses two user input units 370 for a preset time period simultaneously, an alarm of the mobile terminal connected with the wearable sound equipment 300 by BLUETOOTH and the user is able to find the lost mobile terminal.

The voice collected via the microphone 360 of the wearable sound equipment 300 may be stored in the mobile terminal by implementing a voice record function of the mobile terminal connected by BLUETOOTH.

The user may control only the simple functions associated with calls or sound media playing, using the wearable sound equipment. However, the wearable sound equipment in accordance with the present disclosure may have the expanded range of controllable functions.

Figure 2:
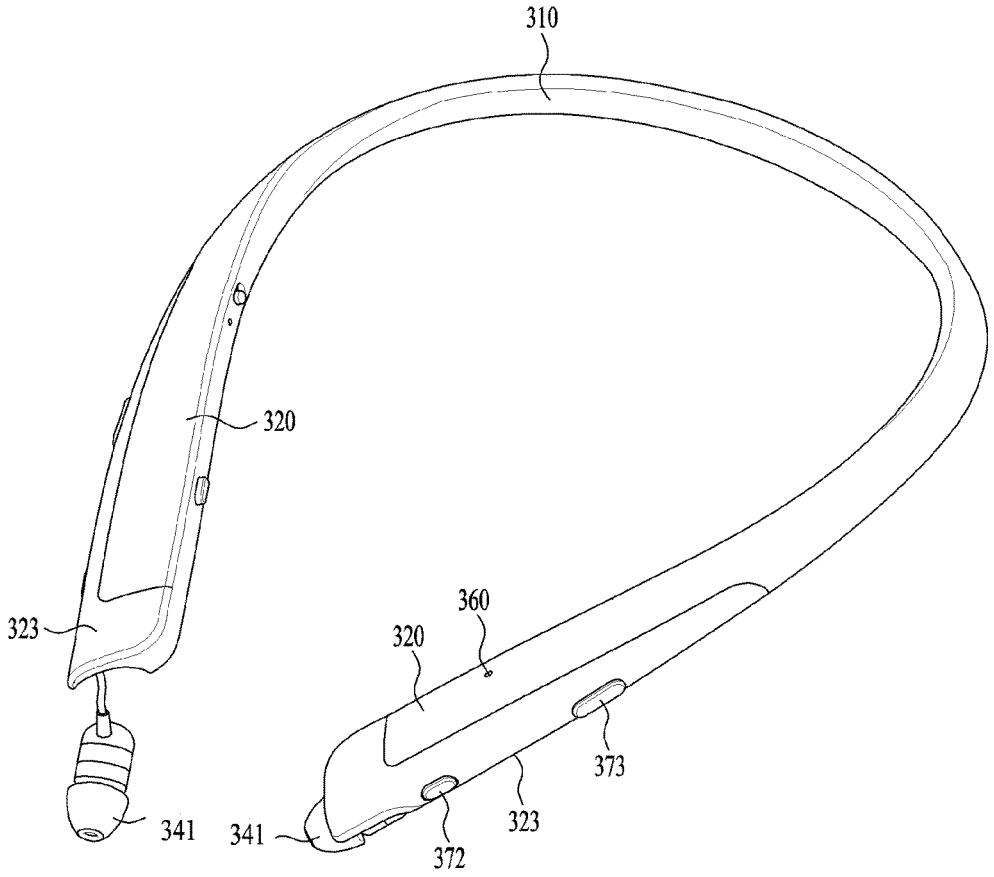
FIG. 2 is a perspective diagram illustrating one example of the wearable sound equipment, viewed in one direction.

FIG. 2 is a perspective diagram illustrating one example of the wearable sound equipment 300, viewed in one direction. Diverse components are mounted in a main body of the wearable sound equipment 300 in accordance with the present disclosure and the main body consists of a band portion 310 and a housing 320. The band portion 310 may form a C-shaped curvature as shown in FIG. 2 and the main body may also form the C-shaped curvature.

Figure 5A:
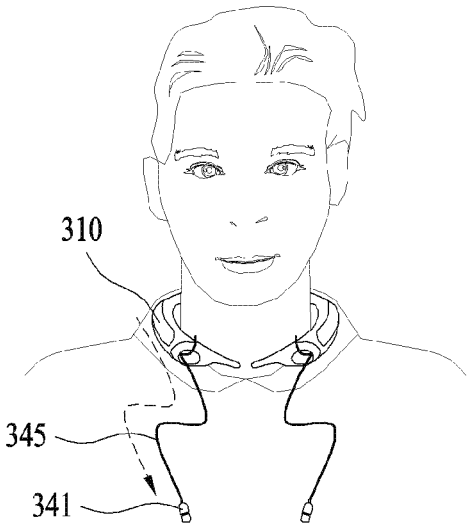
FIGS. 5A and 5B are diagrams illustrating a state where a user is wearing the wearable sound equipment in accordance with the present disclosure.

Referring to FIG. 5A, the C-shaped band portion 310 is insertedly put on the back of the user's neck and the housing 320 is located on the user's clavicle. When the user wears the wearable sound equipment 300, a lower surface of the housing 320 directly contacts with the user's body. The regions of the housing 320 and the band portion 310 which directly contacts with the user's body may be formed of a different material from the material of the other regions or unevenness may be formed in the regions.

The band portion 310 has a twisted tape shape having a surface and a thickness. An internal surface of the band portion 310 is arranged on a back side of the user's neck and an external surface is arranged toward the back side of the user's neck. A connecting portion between the band portion 310 and the housing 320 is twisted so that an external surface of the housing 320 arranged in each end of the main body may toward a front side of the user's neck and an internal surface may contact with the user's clavicle.

The band portion 310 has elasticity. When an external force is applied thereto, the band portion 310 is deformed in a preset range. When the force is released, the band portion 310 is restituted. The housing 320 is coupled to both ends of the band portion 310 located in both ends of the C-shaped curvature of the wearable sound equipment 300. In inner and outer surfaces of the housing 320 may be insertedly loaded a board 381, a wireless communication unit 385, a battery 391, a rotation module and other diverse components.

A sensing unit 375 may be provided in the band portion 310 and uses whether the user wears the wearable sound equipment 300. For example, a displacement sensor for sensing curvature variation is provided to sense the user's widening ends of the wearable sound equipment 300 when the user wears the equipment 300. In this instance, the curvature of the band portion 310 is varied gently and the displacement sensor determines that the user tries to wear the wearable sound equipment 300. The power of the wearable sound equipment 300 is switched on or the wearable sound equipment 300 is synchronized with an external mobile terminal.

To determine whether the user wears the wearable sound equipment or the ends of the wearable sound equipment 300 are widened while carried with the user, the curvature after the curvature of the band portion 310 is largely changed may be considered together. When the curvature is hugely changed by a first value and then uniformly constant by a second value gentler than the curvature in which the wearable sound equipment 300 is put on its mount, it may be determined that the user wears the wearable sound equipment 300 on the neck.

Rather than the displacement sensor, a temperature sensor, an optical sensor or a hear rate sensor may be provided on the wearing surface configured to contact with the neck when the user wears the wearable sound equipment 300, so that it can be determined that the user wears the equipment 300 when the temperature of the equipment 300 is in a range of human body temperatures or latent brightness gets dark or the heart rate is sensed. Then the power of the wearable sound equipment 300 is switched on or the wireless communication unit 385 is implemented to synchronize the wearable sound equipment 300 with an external mobile terminal.

As an alternative example, a switch pressed physically is projected from the surface of the wearable sound equipment. When the user wears the wearable sound equipment 300, the projected switch is pressed and ON-signal is generated. If the ON-state of the switch is kept for a preset time period or more, the power of the wearable sound equipment 300 is turned on or the wearable sound equipment 300 is synchronized with an external mobile terminal.

The board 381, the wireless communication unit 385, the battery 391, the microphone 360 and the rotation module may be loaded in the housing 320 arranged in both ends of the band portion 310.

The housing may include a lower case configured to contact with the user's body and an upper case configured to get exposed upwards when the user wears the wearable sound equipment 300. Diverse electronic components are loaded in the internal space defined by the upper case and the lower case.

The housing 320 is fabricated by injection-molding a polymer material. For example, plastic with certain strength such as Polystyrene (PS) is used for the housing 320. As another example, a material which can give the same feeling as the material of the band portion 310 (for example, polyurethane) is coated on a surface of the housing 320 so that the uniformity between the band portion 310 and the housing 320 can be enhanced.

Polyurethane is a material with a frictional force strong enough to make the band portion 310 and the housing 320 be in close contact with the user's skin. Accordingly, the band portion 310 and the housing 320 will not shake according to the user's movement and may have an effect of good wearing sensation.

The housing 320 may partially include a different material such as metal, glass, leather or the like. Metal can give a classy and solid feeling, which make metal as one of preferred materials. A metal case 323 is likely to affect electrical signals of the components loaded in the housing 320 and it is important to arrange the components.

The wearable sound equipment 300 wearable on the user's body part is easily exposed to moisture such as sweat. If a waterproof function is additionally provided, the durability of the wearable sound equipment 300 can be enhanced. A rib for covering a gap between the upper case and the lower case or a waterproof material disposed between them may be provided to prevent water from permeating through the gap. Even without auxiliary waterproof material, polyurethane coating makes the upper case and the lower case sealed with each other in close contact.

The wireless communication unit 385, the microphone 360 and the like may be mounted in the board 381. The board 381 is connected with the battery 391, the user input unit 370, an antenna radiator 386 and the audio output unit 340. The components loaded in the housings 320 may be arranged in both of the housings 320 symmetrically or only one housing together with a vibration module.

In case data and electric power needs to be transceived between the components loaded in one of the housings and the components loaded in the other one, the band portion 310 may further include a signal wire. For example, if the battery is arranged only in one of the housings, the power of the battery may be transferred to the other one via the signal wire. If the wire communication unit 385 arranged in first housing 320*a* receives a signal, a sound signal may be sent to the cable 345 located in the second housing 320*b* via the signal wire.

The wireless communication unit 385 is loaded in the board 381 or in the surface of the housing 320, to transceive a signal with an external terminal. The wireless communication unit 385 is synchronized with an external terminal by short range wireless communication such as BLUETOOTH and receives a control signal and sound signal from the external terminal or transmit the control command and sound signal input through the user input unit 370 or the microphone 360 to the external terminal.

The housing 320 may include a power button for switching the power to be ON/OFF, a button 372 for playing or calling, a direction key 373 for controlling a volume and the like (the direction key is able to be used for playing the former or the latter of the playing music). A dome key configured to be pressed physically or a touch key configured to sense capacity variation may be used as the button.

In case of the touch key, the location is not limited and determined in all area of the surface of the housing 320. When the touch key is provided in the surface of the housing 320, LED for displaying the location and function of the touch key may be provided in the region where the touch key is realized. The earbuds 341 is insertedly put on the user's ears to deliver sound and connected to the board 381 via the cable 345. The board 381 controls the earbuds 341 to output sound according to the sound signal.

Figure 3:
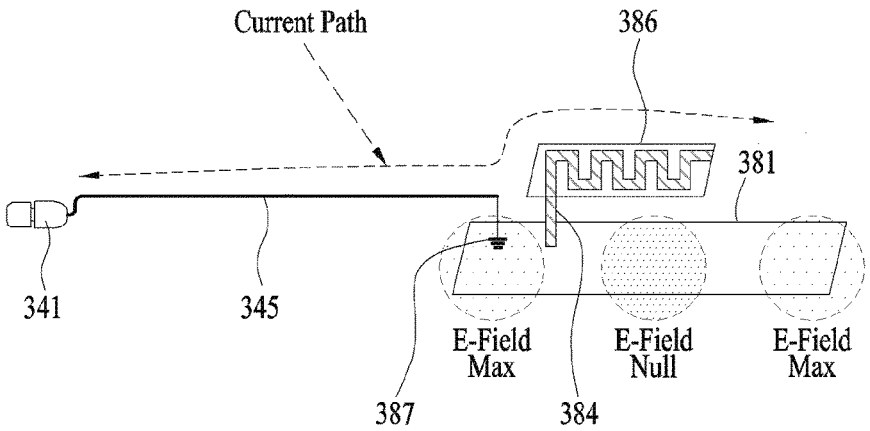
FIG. 3 is a diagram illustrating a cable and an antenna radiator which are provided in one example of the wearable sound equipment.

FIG. 3 is a diagram illustrating a cable 345 and an antenna radiator 386 which are provided in one example of the wearable sound equipment 300. The wireless communication unit 385 provided in the illustrated example of the wearable sound equipment 300 includes an antenna radiator 386. The antenna radiator 386 may be realized as a pattern made of a conductive material and the length of the pattern is proportional to the wavelength of resonant frequency. The lower is a frequency, the longer is the wavelength. The length of the antenna radiator 386 is one half or one fourth of the wavelength.

As an alternative example, the conductive pattern is bent so as to provide the antenna radiator 386 having the corresponding length to one half or one fourth of the wavelength of the resonance frequency in a short space.

The antenna radiator 386 may be spaced a preset distance apart from the internal components to minimize the interference in the internal components loaded in the housing 320. The board 381 is arranged near the lower housing 320 and diverse components are loaded on the board 381, and the antenna radiator 386 is arranged near the upper case. For example, the antenna radiator 386 configured of the conductive pattern is attached to an inner surface of the upper case.

The antenna radiator 386 is connected with the board 381 and provided with the electric power. When preset-sized electric currents flow to the antenna radiator 386, the antenna radiator 386 may transceiver a signal having a wavelength corresponding to the resonance frequency. The connected portion of the antenna radiator 386 with the board 381 to supply the electric power to the antenna radiator 386 is referred to as "feeder 384".

The electric currents supplied by the feeder 384 flow to the antenna radiator 386 and the antenna radiator provided with the electric currents radiates a signal. The wearable sound equipment 300 is worn on the user's body part so that the quality of the signal might be deteriorated by the effect of the user's body part. Also, electromagnetic waves might have band effect on the user. Accordingly, it is necessary to adjust the radiation direction of the antenna radiator 386 in the opposite direction of the equipment usage.

Figure 10:
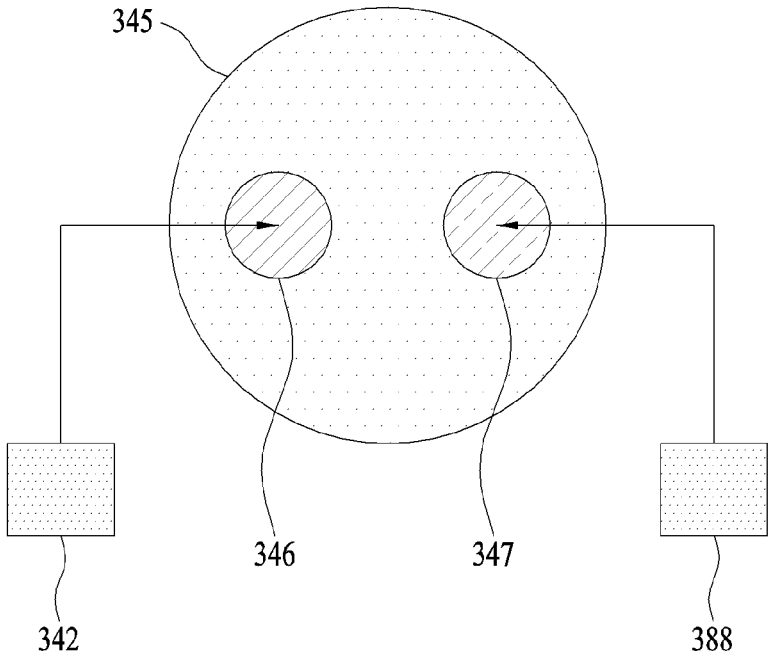
FIG. 10 is a sectional diagram of a cable provided in the further example of the wearable sound equipment.

The cable 345 includes a conductivity line to transmit a sound signal (see FIG. 10). The cable 345 includes an audio line 346 and a ground line 347 provided therein. The audio line 346 is connected to an audio chipset 342 loaded in the board 381 for transmitting sound data. The ground line 347 is connected to ground of the board 381 for the quality of the signal transmitted along the audio line 346.

The audio line 346 transmits a sound signal. If other currents flow to the audio line 346, the sound signal might be affected. No signals flow along the ground line 347 and the radiation direction of the antenna radiator 386 may be controlled by using the ground line 347.

Figure 4:
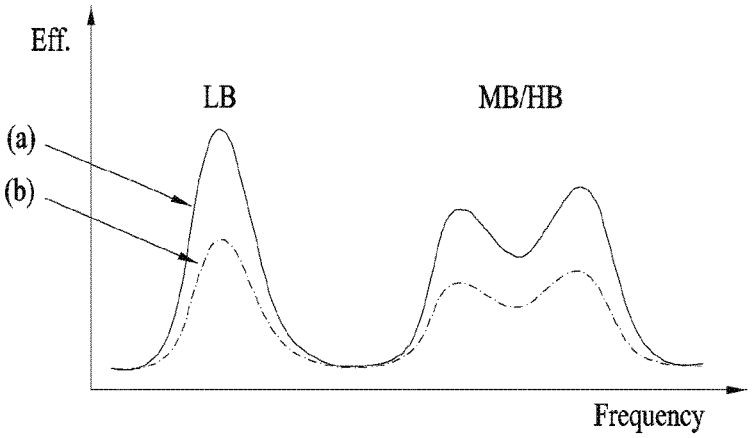
FIG. 4 is a graph illustrating antenna performance according to location of a ground point of a cable and location of antenna feeder provided in one example of the wearable sound equipment.

If the ground line 347 of the cable 345 is arranged near a ground connection 387 of the board 381, the electric power is applied to the antenna radiator 386 from the feeder 384 and electric currents flow even to the ground line 347 of the cable 345 by the electric field. Accordingly, the electric field intensively concentrated only on the body is able to be dispersed to the cable 345, FIG. 4 is a graph illustrating the capacity of antenna in case the distance between the ground connection 387 and the feeder 384 is short (see (a)) and long (see (b)). The antenna resonates at a low band (LB) and a middle/high band (MB/HB). It is shown that the antenna has higher efficiency at the resonance frequency in case of the shorter distance between the ground connection 387 and the feeder 384.

The strength of the electric field is the strongest at an end of a conductor. As shown in FIG. 3, the strength of the electric field is the highest (the maximum) at both ends of the board 381 (E-Field Max) and the lowest (or null) at the middle in a middle portion of the board 381 (E-Field Null). Accordingly, the ground connection 387 connected to the ground line 347 has to be arranged adjacent to the end of the board 381 so as to minimize the concentration of the electric field on the end of the board 381. The ground connection 387 and the feeder 384 may be arranged near the end of the board 381 so that the performance of the wireless communication unit 385 may be enhanced.

Figure 5B:
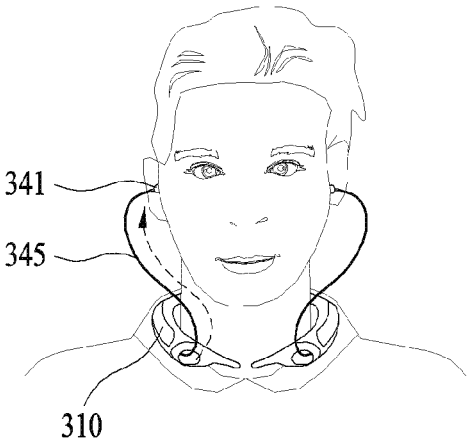

FIGS. 5A and 5B are diagrams illustrating the state where the wearable sound equipment 300 is worn on the user's neck. As shown in FIG. 5A, the cable 345 is extracted from the body longitudinally so that it may not contact with the user's body part closely. Accordingly, there is an advantage of dispersing the electric field in the direction which becomes farther from the user's body part.

When the user wears the earbuds 341 on the ears as shown in FIG. 5B, the currents flowing along the ground line 347 are likely to flow to the user's head disadvantageously. Especially, since the electric field is most intensively concentrated on the end of the conductor, there might be a disadvantage that the largest electric field is generated near the user's ears.

Figure 6:
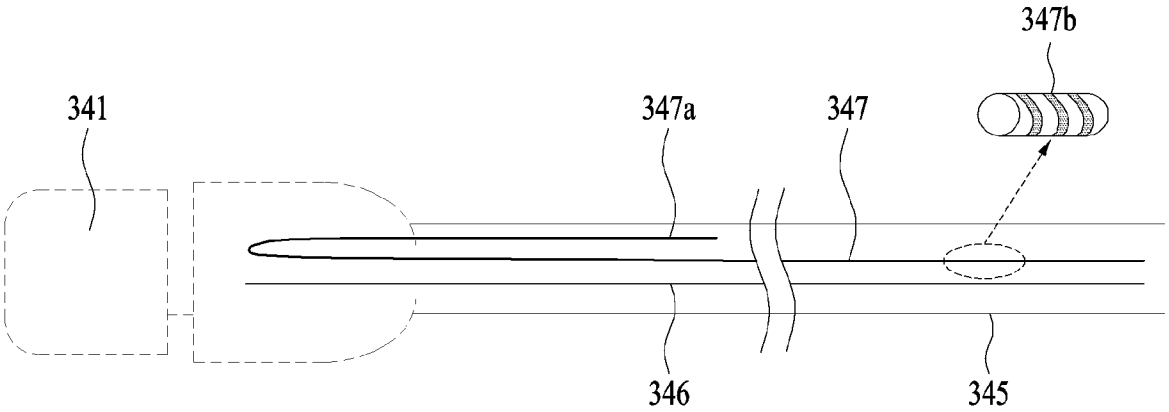
FIG. 6 is a diagram illustrating the shape of ground line provided in the wearable sound equipment in accordance with the present disclosure.

FIG. 6 is a diagram illustrating the shape of the ground line 347 provided in the wearable sound equipment 300 of the present disclosure. The end 347*a* of the ground line 347 is bent to become spaced a preset distance from the user's ear. Alternatively, the end 347*a* toward the earbud of the ground line 347 may be extended only to the middle portion of the cable 345, not to the earbud 341.

The electric field is concentrated on the portion wound in a coil shape. A coil 347*b* wound around a certain area of the ground line 347 in a spiral may be formed as shown in FIG. 6 and the strength of the electric field may be concentrated in the area spaced a preset distance apart from the user's ear.

Figure 7A:
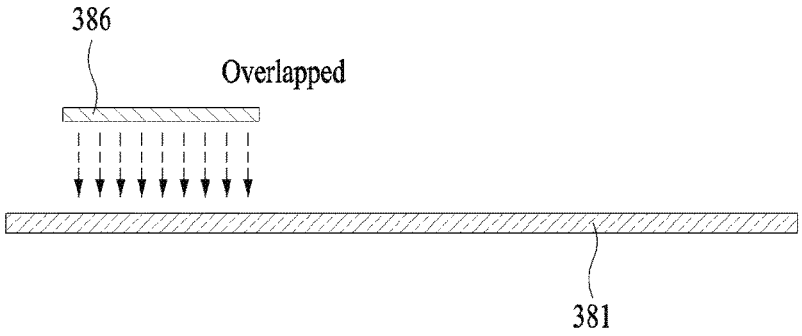
FIGS. 7A to 7C are diagrams illustrating the strength of the electric field formed in a board by an antenna of the wearable sound equipment in accordance with the present disclosure.
Figure 7B:
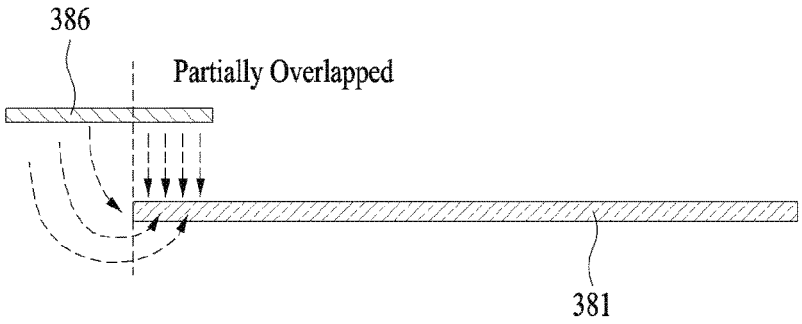
Figure 7C:
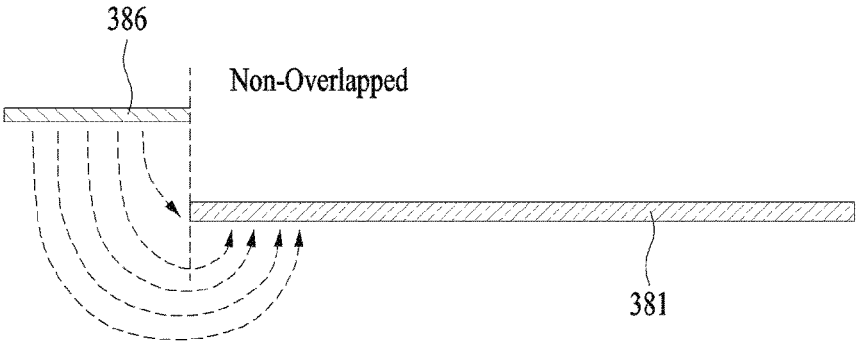

FIGS. 7A to 7C are diagrams illustrating the strength of the electric field formed in the board 381 by the antenna of the wearable sound equipment 300. When the currents supplied from the feeder 384 flow to the antenna radiator 386, an electric field is formed. A conductive material is arranged on the board 381 and an electric field is formed even between the board 381 and the antenna radiator 386.

In case the antenna radiator 386 is overlapped with the board 381 as shown in FIG. 7A, the electric field is concentrated between two conductors. In case the antenna radiator 386 and the board 381 are partially overlapped or not overlapped as shown in FIG. 7B or 7C, the electric field while drawing a curved line is dispersed even under the board 381. Since it is generally arranged in the lower case, the board 381 of the wearable sound equipment 300 worn by the user is located beyond the user's body part. In case of the arrangement shown in FIGS. 7B and 7C, the electric field is likely to affect the user's body in many ways. The antenna radiator 386 in accordance with the present disclosure is overlapped with the board 381 to reduce the electric field dispersed toward the user's body.

Figure 8:
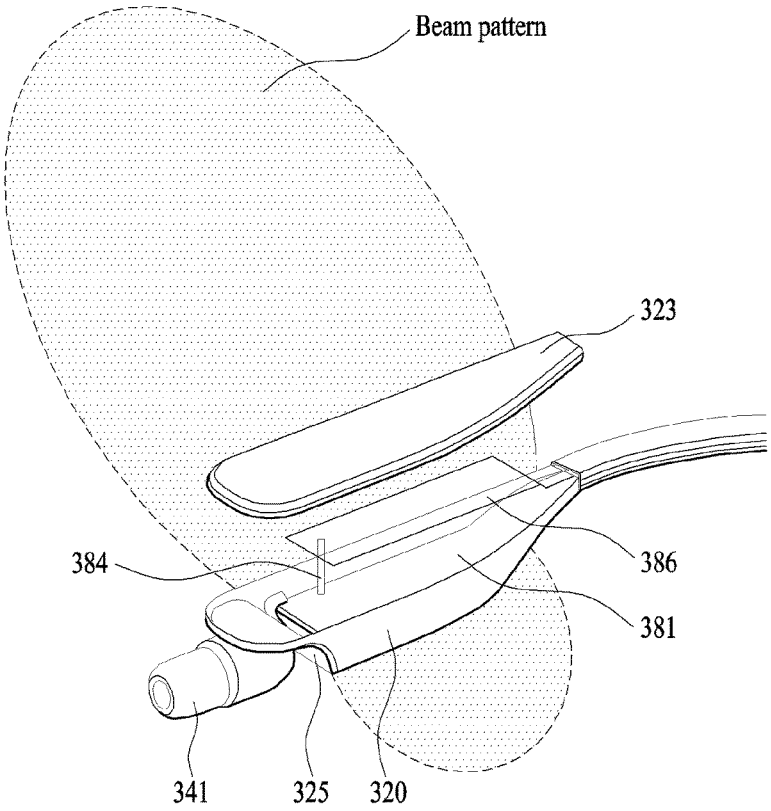
FIG. 8 is a diagram to explain a radial type of another example of the wearable sound equipment in accordance with the present disclosure.

FIG. 8 is a diagram is a diagram to explain a radial type of another example of the wearable sound equipment 300 in accordance with the present disclosure. The housing 320 in the illustrated example of the wearable sound equipment 300 may include a metal case 323 and the metal case 323 is also made of a conductive material. When the metal case 323 is arranged on the antenna radiator 386 as shown in FIG. 8, a radiation pattern is induced toward the metal case 323 as similarly as the radiation pattern is changed by inducing currents to the ground line 347 mentioned above.

The electric field flowing to the user's body is induced upwards by the metal case 323, so that the electromagnetic wave which affects the user can be minimized and that the performance of the signal can be improved.

Figure 9:
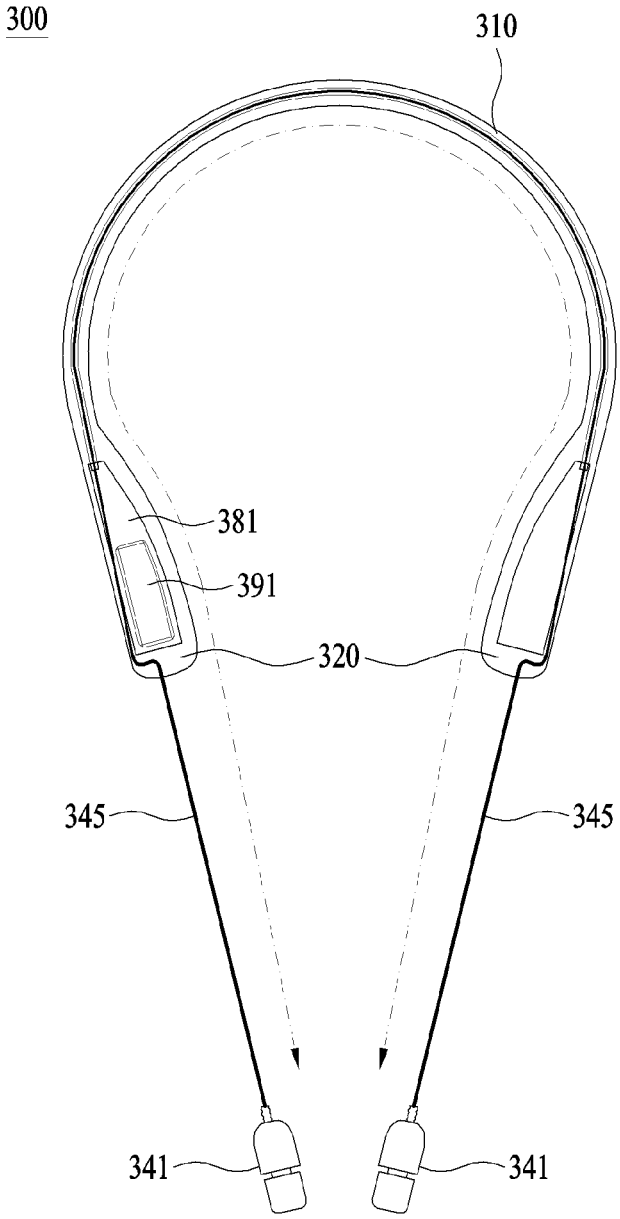
FIG. 9 is a diagram illustrating the arrangement of a cable provided in a further example of the wearable sound equipment in accordance with the present disclosure.

FIG. 9 is a diagram illustrating the arrangement of the cable 345 provided in the wearable sound equipment 300. The wearable sound equipment 300 is wirelessly connected to a mobile terminal and receives from the mobile terminal to provide sound to the user, using short range wireless communication. To directly communicate with a base station wirelessly in addition to the function mentioned above, the wearable sound equipment 300 needs to include not only an antenna for short range wireless communication but also an auxiliary antenna.

The antenna radiator 386 has to be provided with a length corresponding to a half or a fourth of the wavelength possessed by the resonance frequency to cover signals in a low frequency band such as a radio signal. AM frequency is higher than FM frequency and even FM frequency uses signals in a frequency band of 88.1~108.1 MHz. The wavelength of FM frequency is approximately 2.8 m~3.4 m. Even using the antenna radiator 386 with a corresponding length to a fourth of the wavelength, the conductor with a length of approximately 70 cm~85 cm is required.

To mount the conductor with the length of 70 cm~85 cm in the wearable sound equipment 300 in accordance with the present disclosure, the conductor has to be wound around like a coil. However, if such a coil is mounted, the overall thickness becomes increased and an electric field and a magnetic field are generated by the coil only to deteriorate the antenna performance. To prevent the deterioration of the antenna performance, a material for shutting off the electric field such as ferrite has to be disposed in the coil. In this instance, the wearable sound equipment 300 becomes heavier and the production cost rises advantageously.

Accordingly, the present disclosure uses the ground line 347 of the cable 345 as the antenna radiator 386 for receiving the signal in the FM frequency band. One end of the conventional cable 345 is connected to the earbud 341 and the other end is connected to the board 381 loaded in the housing 320. However, right and left ends of the cable 345 in accordance with the present disclosure is united and extended along the band portion 310. In other words, a conductor connected from one earbud 341 to the other earbud 341 is realized along the band portion 310. The overall length of the cable 345 has to be corresponding to one fourth of the wavelength possessed by the FM frequency so as to resonate with the signal with FM frequency.

FIG. 10 is a sectional diagram of a cable 345 provided in the further example of the wearable sound equipment 300. The audio line 346 loaded in the cable 345 is connected to the audio chipset 342 as mentioned above and provided with a sound signal from the board 381, to send the sound signal to the audio output unit of the earbud 341 and to output sound.

If overcurrent flows to the cable 345, the ground line 347 connected to the ground of the board 381 is arranged in parallel with the audio line 346 to prevent damage to the wearable sound equipment 300 and the user from getting an electric shock. The ground line 347 is not configured to transceive a signal directly and the ground line 347 is connected to the FM chipset 388 and it is used as the radiator 386 of FM signal.

Figure 11A:
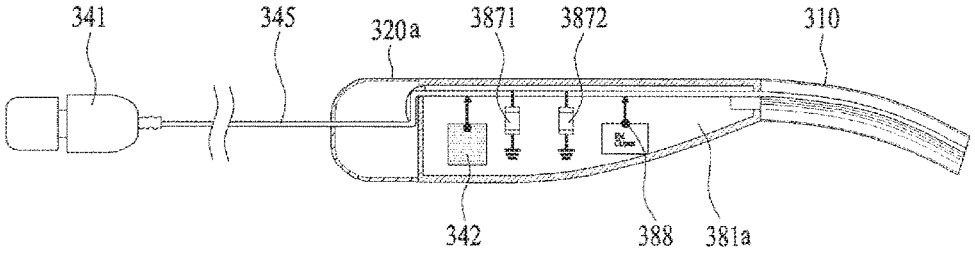
FIGS. 11A and 11B are diagrams illustrating the components connected to the cable provided in the further example of the wearable sound equipment.
Figure 11B:
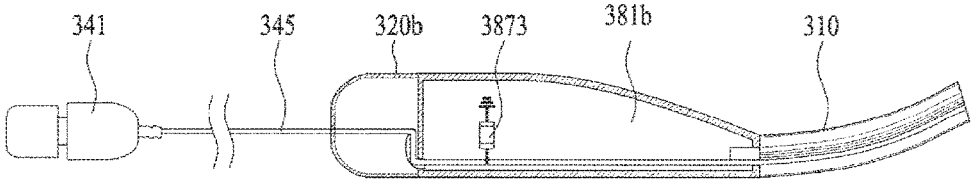

FIGS. 11A and 11B are diagrams illustrating the components connected to the cable 345 provided in the further example of the wearable sound equipment 300. The components connected to the cable 345 includes an audio chipset 342 connected to the audio line 346, a FM chipset and a FM matching network 3872 connected to the ground line 347.

The FM chipset 388 provides electric current corresponding to FM signal to the ground line 347 and the ground line 347 receives the FM signal. The FM signal the ground line 347 received is sent to the audio chipset 342 through the FM chipset 388 and then to the earbud 341.

The FM matching network 3872 is connected to the ground of the board 381. The ground line 347 adjusts frequency and changes frequency characteristics a little bit to receive the FM signals different according to broadcasting companies. The FM matching network 3872 may include one or more of capacitors, an inductor and a switch. A plurality of FM matching networks 3872 may be provided and an audio matching network 3871 may be provided together with the FM matching network 3872 or independently. The audio matching network 3871 is also connected to the ground of the board 381. If the FM matching network 3872 is differentiated, the connecting state of the audio matching network 3871 is also differentiated.

The audio chipset 342, the FM chipset 388, the FM matching network 3872 and the like may be mounted in the first board 381*a* loaded in a first housing 320*a* as shown in FIG. 11A. The configuration is not mounted in a second board 381*b* loaded in a second housing 320*b* and the second board 381*b* receives necessary data from the first board 381*a* as shown in FIG. 11B. The ground line 347 has to be connected to the second board 381*b* for the quality of the sound signal transmitted via the cable 345 located in the second housing 320*b*. In case the ground line 347 is connected to the ground of the second board 381*b*, electric currents do not flow to the cable 345 extended outwards from the second housing 320*b* and to the ground connection 387 connected to the ground of the second board 381*b*. It becomes impossible to secure the length of the radiator 386 enough to receive the FM signal.

To solve the disadvantage, a filter device 3873 shutting off the signal in the frequency band corresponding to the FM signal may be provided. The filter device 3873 may shut off electric currents flowing to the second board 381*b* and the ground connection 387 of the ground line 347 with respect to the FM frequency signal and allows electric currents flowing along the ground line 347 of the cable 345.

As mentioned above, the flux of the electric field formed by the antenna radiator 386 is adjusted by using the cable or the metal case 323 exposed outside. Accordingly, the antenna performance may be improved and the effect on the human body may be minimized.

In addition, no auxiliary radiator 386 is provided and the ground line 347 of the cable 345 is used in transceiving the FM signal. Accordingly, the performance of the wearable sound equipment 300 may be improved.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A wearable sound equipment comprising:

a main body shaped to be wearable on a user's body part;

an earbud comprising an audio output unit;

a board located in the main body and comprising a ground;

a cable having a first end coupled to the main body and a second end coupled to the earbud, the cable comprising an audio line and a ground line;

an audio chipset coupled to the audio line and configured to transmit a sound signal to the audio output unit;

an antenna radiator located in the main body;

a feeder connecting the board and one end of the antenna radiator and configured to supply electric power to the antenna radiator; and a ground connection located between the ground and the ground line, the ground connection connecting a first end of the ground line and the ground of the board, wherein connection points of both the feeder and the ground connection are located at one end portion of the board that is away from a middle portion of the board such that the feeder and the ground connection are positioned near one another, and wherein an electric field is stronger at the one end portion of the board than the middle portion of the board.

2. The sound equipment of claim 1, wherein a distance between the ground connection and an end of the board corresponding to the one end portion is shorter than a distance between the feeder and the end of the board.

3. The sound equipment of claim 1, wherein a second end of the ground line does not extend to the earbud.

4. The sound equipment of claim 1, wherein the ground line extends from the first end toward the earbud and is bent inside the cable toward the main body such that a second end of the ground line is located at a portion of the cable that is located between a bent portion of the ground line and the first end of the ground line.

5. The sound equipment of claim 1, wherein the ground line comprises a coil spirally wound around a middle portion of the ground line.

6. The sound equipment of claim 1, wherein the antenna radiator is located on the board overlapping the board.

7. The sound equipment of claim 1, wherein:

the main body comprises a first surface configured to contact the user wearing the sound equipment and a second surface opposite to the first surface, the second surface including a metal case; and the board and the antenna radiator are located between the first surface and the second surface such that the board is proximate to the first surface and the antenna radiator is proximate to the second surface.

8. The sound equipment of claim 1, wherein the main body comprises:

a band portion curved in a C-shape and wearable around the user's neck; and a pair of housings each formed at a corresponding end of the band portion, wherein the earbud comprises a pair of earbuds and the cable is extended along the band portion such that each of the pair of earbuds is coupled to a corresponding end of the band portion, and wherein the sound equipment further comprises a Frequency Modulation (FM) chipset coupled to the ground line and configured to receive an FM signal.

9. The sound equipment of claim 8, further comprising:

an FM matching network connecting the ground line and the ground of the board.

10. The sound equipment of claim 8, further comprising:

a filter device connecting the ground line and the ground of the board and configured to shut off a signal in a frequency band corresponding to the FM signal.

11. A wearable sound equipment comprising:

a main body comprising a band portion shaped to be wearable around a neck of a user and a pair of housings including a first housing and a second housing, each housing formed at a corresponding end of the band portion;

a cable extended along the band portion, each end of the cable penetrating an end of a corresponding one of the pair of housings, the cable further extended to outside of the pair of housings, and the cable comprising an audio line and a ground line;

a pair of earbuds, each earbud coupled to a corresponding end of the cable and comprising an audio output unit;

a first board located in the first housing and a second board located in the second housing, each of the first board and the second board having a ground;

an audio chipset located at the first board, coupled to the audio line and configured to transmit a sound signal to the audio output unit;

a Frequency Modulation (FM) chipset located at the first board, coupled to the ground line and configured to receive an FM signal;

a filter device located at the second board, positioned between the ground line and the ground and configured to shut off the FM signal; and an FM matching network located at the first board, positioned between the ground line and the ground and configured to adjust a frequency of the FM signal.

12. The sound equipment of claim 11, wherein a length of the ground line corresponds to one fourth of a wavelength of the FM signal.

13. The sound equipment of claim 11, wherein a length of the ground line is at least 70 cm and at most 85 cm.

14. The sound equipment of claim 11, further comprising:

an audio matching network connecting the ground line and the ground.

* * * * *